US005115713A

United States Patent [19]

Muller et al.

[11] Patent Number: 5,115,713

[45] Date of Patent: May 26, 1992

[54] APPARATUS FOR THE INFEED OF CARTRIDGES TO A FIRING WEAPON

[75] Inventors: Kurt Muller, Zurich; Erwin Bohler, Dubendorf; Jurg Dunki, Dietikon, all of Switzerland

[73] Assignee: Oerlikon-Contraves AG, Zurich, Switzerland

[21] Appl. No.: 698,075

[22] Filed: May 10, 1991

[30] Foreign Application Priority Data

May 22, 1990 [CH] Switzerland ..... 01743/90

[51] Int. Cl.[5] ..... F41A 9/34; F41A 9/30

[52] U.S. Cl. ..... 89/33.14; 89/33.16; 89/33.4

[58] Field of Search ..... 89/33.1, 33.14, 33.16, 89/33.17, 33.04, 33.03, 34, 33.5, 33.4

[56] References Cited

U.S. PATENT DOCUMENTS

| | | | |
|---|---|---|---|
| 2,993,415 | 7/1961 | Panicci et al. . | |
| 3,696,704 | 10/1972 | Backus et al. | 89/34 |
| 4,004,490 | 1/1977 | Dix et al. | 89/34 |
| 4,137,820 | 2/1979 | Clemens | 89/34 |
| 4,253,376 | 3/1981 | Washburn et al. | 198/347 |
| 4,494,440 | 1/1985 | Koine | 89/33.04 |
| 4,509,401 | 4/1985 | Pollock | 89/34 |
| 4,765,223 | 8/1988 | Beckmann | 89/33.04 |
| 4,876,940 | 10/1989 | Aloi et al. | 89/33.16 |
| 4,881,447 | 11/1989 | Yanusko et al. | 89/33.16 |
| 4,951,547 | 8/1990 | Novet et al. | 89/34 |

FOREIGN PATENT DOCUMENTS

| | | | |
|---|---|---|---|
| 0020095 | 12/1980 | European Pat. Off. | 198/347 |
| 0361050 | 4/1990 | European Pat. Off. | 89/34 |
| 2760173 | 5/1985 | Fed. Rep. of Germany | 89/33.04 |
| 3644513 | 6/1988 | Fed. Rep. of Germany | 89/34 |

*Primary Examiner*—Stephen Johnson

*Attorney, Agent, or Firm*—Sandler, Greenblum & Bernstein

[57] ABSTRACT

During the infeed of cartridges from an ammunition container or magazine to a firing weapon, problems arise in the event there are not simultaneously fulfilled the following three requirements: (a) the first cartridge of a firing burst or series firing should be first delivered to the firing weapon following completion of the run-up-to-speed of the firing weapon; (b) the last cartridge of a firing burst or series firing should be delivered to the firing weapon before the firing weapon has been braked; and (c) the spent cartridge cases should be returned by the cartridge infeed apparatus to the ammunition container. To fulfill these objectives, there is provided an arrangement composed of an endless storage chain, a transfer location, and a switchable gate, in order to allow the temporary storage of spent cartridge cases during reverse movement of the cartridge transport apparatus.

2 Claims, 12 Drawing Sheets

APPARATUS FOR THE INFEED OF CARTRIDGES TO A FIRING WEAPON

CROSS-REFERENCE TO RELATED APPLICATIONS

This application is related to the commonly assigned United States application Ser. No. 07/671,111, filed Mar. 15, 1991, and entitled "APPARATUS FOR THE INFEEDING OF CARTRIDGES".

BACKGROUND OF THE INVENTION

1. Field of the Invention

The present invention relates to a new and improved apparatus for the infeed of cartridges or ammunition rounds to a firing weapon, especially a multi-barrel gun or cannon having a rotating cluster or array of weapon barrels, from an ammunition container or magazine secured to such firing weapon.

In its more specific aspects, the apparatus for the infeed of cartridges or ammunition rounds to a firing weapon from an ammunition container or magazine secured to such firing weapon, is of the type comprising a storage and conveyor chain arranged in the ammunition container, an infeed chain for the transport of the cartridges from the ammunition container to the firing weapon, and a transfer location where the cartridges arrive from the storage and conveyor chain of the ammunition container at the infeed chain.

2. Discussion of the Background and Material Information

European Patent Application No. 0,020,095, published Dec. 10, 1980, teaches a prior art construction of cartridge infeed apparatus of this type, wherein there is provided a storage for the cartridges. A transport chain is guided through an infeed channel and a return channel. The infeed channel opens into a transfer station of the firing weapon. At the transfer location between the infeed channel and the storage or supply channel there is arranged a gate or switch. In one position of the gate, ammunition moves from the infeed channel to a second transport chain leading to the transfer station of the firing weapon. In the other position of this gate, ammunition at the transport chain moves through the storage or supply channel into the return channel. By means of a switch or trigger mechanism which is connected with the firing weapon, it is possible to switch or shift the gate from its first position into its second position. The transfer station of the firing weapon continues to further forwardly rotate until all cartridges have been removed from the second transport chain. The first transport chain moves further forwards and places the ammunition into the storage or supply channel. A reversing device or mechanism subsequently rearwardly moves or reverses the first transport chain until the ammunition in the storage or supply channel again is positioned in the infeed channel while the transfer station is completely emptied. Thus, the ammunition which is temporarily contained in the storage or supply channel can be delivered to the firing weapon during the next firing burst or blast.

In the case of a multi-barrel gun or cannon which is located upon a vehicle, it is frequently not desired that the empty or spent cartridge cases are simply jettisoned. In the event that the empty or spent cartridge cases should also be returned to the ammunition container or magazine by means of the same apparatus which serves to infeed the cartridges to the firing weapon, then problems can arise during the run-up-to-speed of the firing weapon, that is, the run up of the firing weapon until reaching its maximum or full firing rate or cadence.

SUMMARY OF THE INVENTION

Therefore, with the foregoing in mind, it is a primary object of the present invention to provide an improved apparatus for the infeed of ammunition to a firing weapon in a manner which is not afflicted with the aforementioned drawbacks and limitations of the prior art.

Another and more specific object of the present invention aims at the provision of an improved apparatus for the infeed of cartridges or the like to a firing weapon, by means of which the empty or spent cartridge cases can be transported away from the firing weapon, wherein the cartridges are removed from an ammunition container or magazine and the empty or spent cartridge cases are delivered to the same ammunition container or magazine, the first or lead cartridge is fed to the firing weapon only after the firing weapon has run-up-to-speed, and upon completion of a firing burst, upon standstill of the firing weapon, further cartridges are infed which are not, however, fired, rather like the empty or spent cartridge cases are returned to the ammunition container.

In keeping with the immediately preceding object, it is a further object of the present invention to provide an apparatus for the infeed of cartridges to a firing weapon wherein not only the first round of a firing burst is fired following run-up-to-speed of the firing weapon, but also the last round of the firing burst should be fired prior to braking of the firing weapon.

Now in order to implement these and still further objects of the present invention, which will become more readily apparent as the description proceeds, the ammunition or cartridge infeed apparatus of the present development is manifested, among other things, by the features that there is provided an endless storage chain, a further or second transfer location, and a switchable gate so that, upon return or reverse movement of the infeed chain and the storage and conveyor chain, empty or spent cartridge cases are transported from the storage and conveyor chain into the endless storage chain.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the firing weapon system including the ammunition container or magazine and cartridge infeed apparatus have been depicted therein, in order to simplify the illustration, as needed for those skilled in the art to readily understand the underlying principles and concepts of the present invention.

Figure 1:
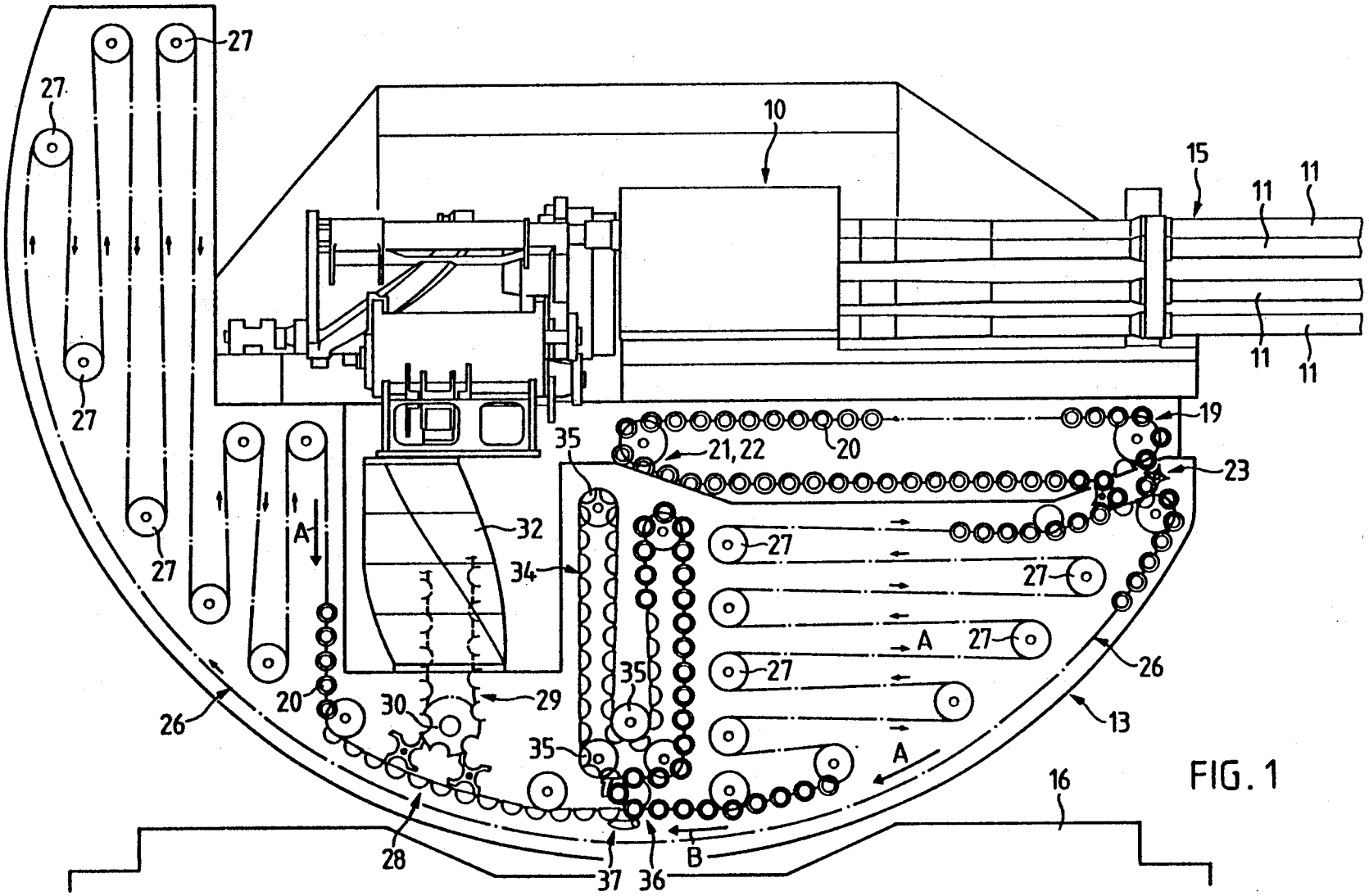
FIG. 1 is a side view of the complete firing weapon system including the associated ammunition container or magazine and cartridge infeed apparatus of the present invention.
Figure 2:
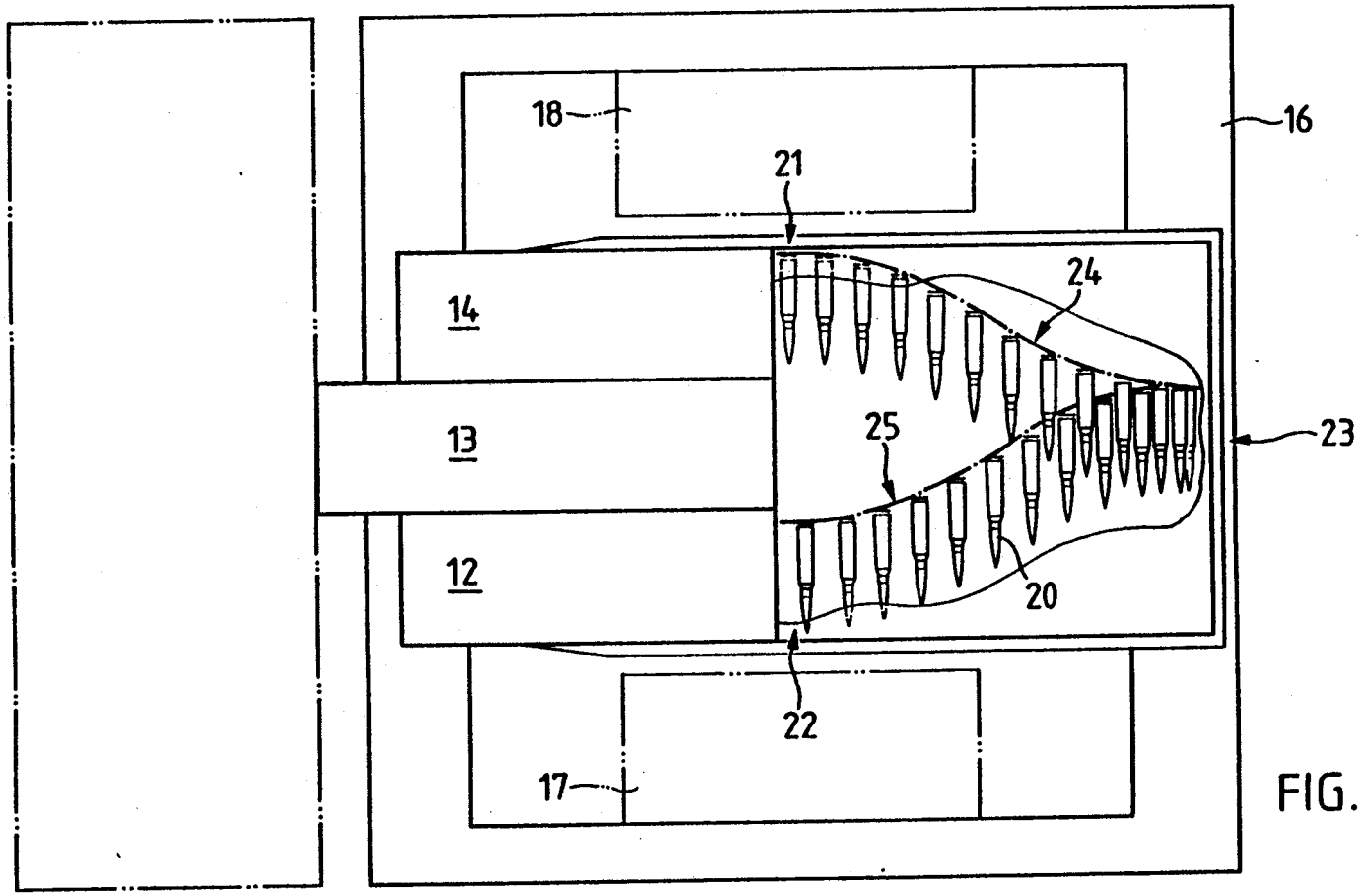
FIG. 2 is a top plan view of the complete firing weapon system including the associated ammunition container or magazine and cartridge infeed apparatus depicted in FIG. 1.
Figure 3:
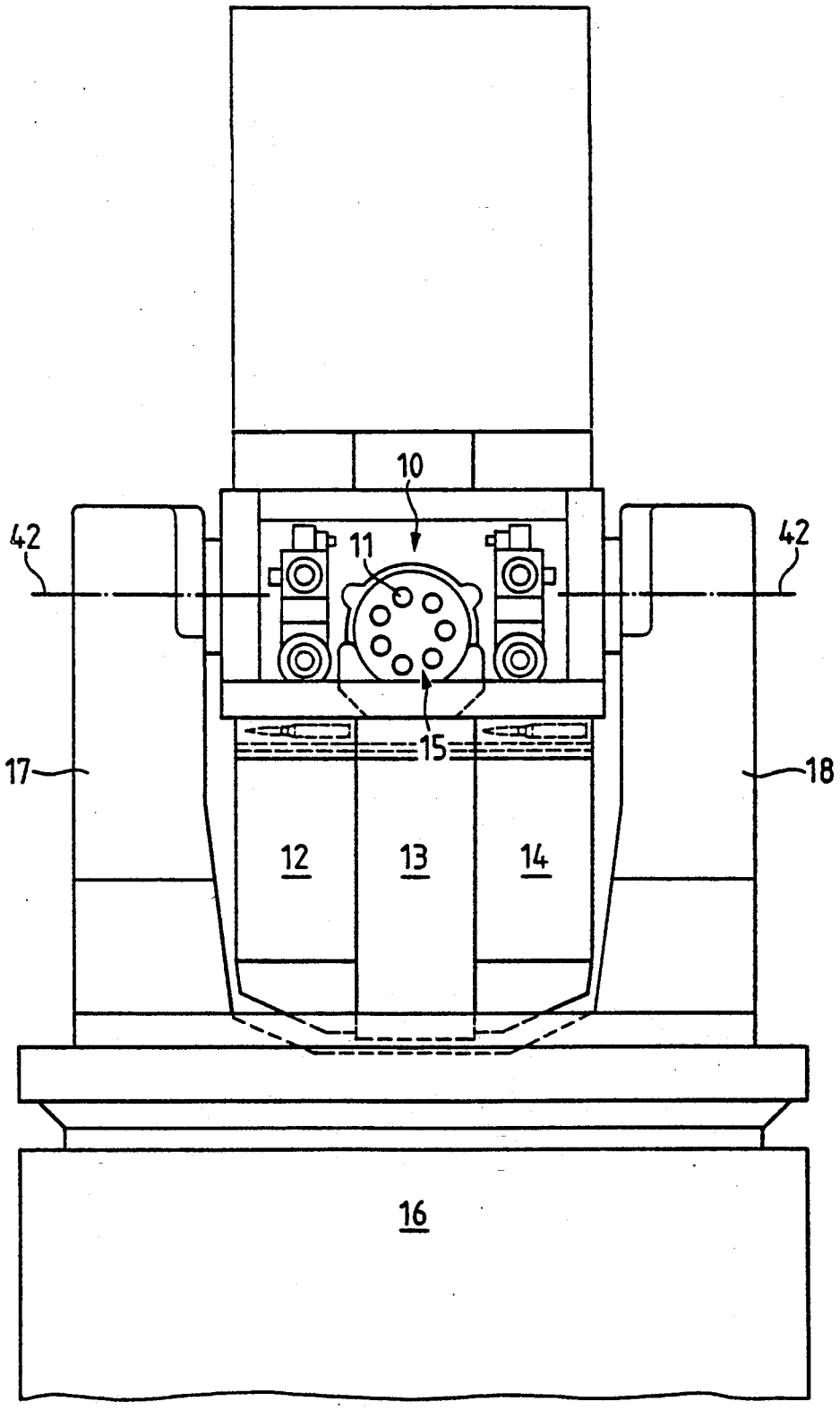
FIG. 3 is a front view of the complete firing weapon system including the associated ammunition container or magazine and cartridge infeed apparatus depicted in FIG. 1.
Figure 5:
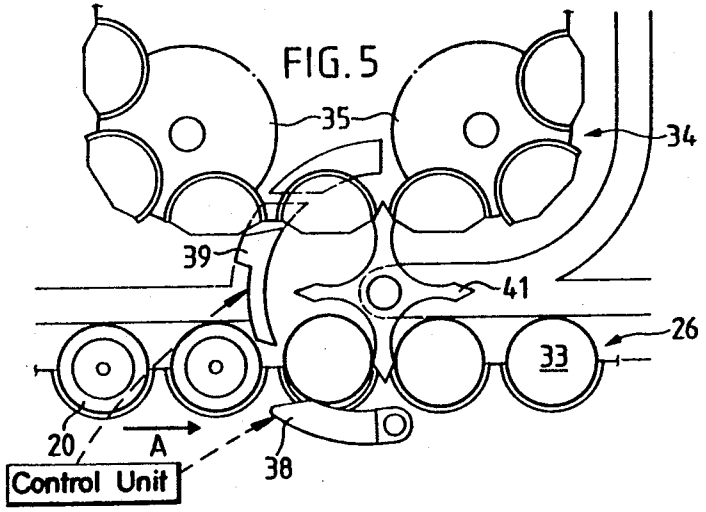
FIGS. 4 to 7 depict on an enlarged scale and in four different positions a gate or switch of the firing weapon system depicted in FIG. 1.
Figure 7:
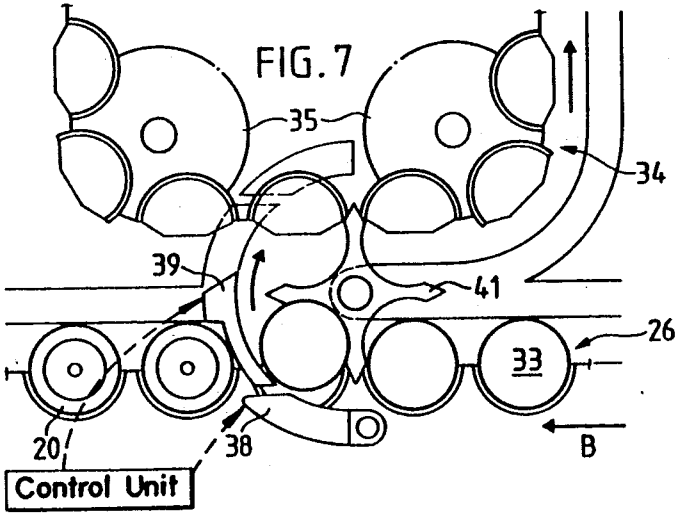
Figure 4:
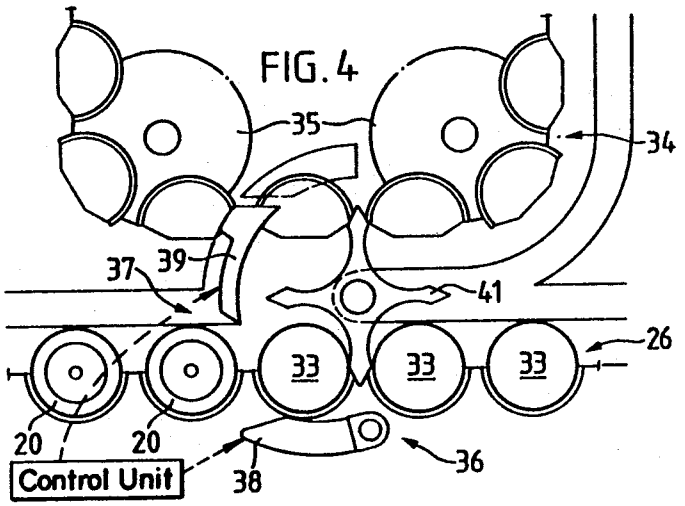
Figure 6:
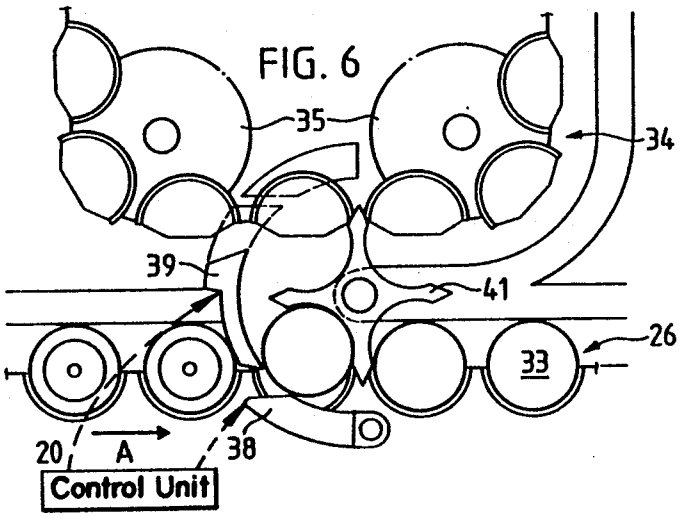

Turning attention now to FIGS. 1 to 3, it will be observed that three ammunition containers or magazines 12, 13 and 14, of which only the intermediate ammunition container 13 is depicted in FIG. 1, are located beneath a Gatling-type gun or cannon 10 having, for example, seven weapon barrels 11. Details of the Gatling-type gun 10 are not part of the subject matter of the present invention and therefore will not be here further considered. What is of significance in the context of this description, is that such Gatling-type gun 10 possesses a rotating weapon barrel cluster or array which is composed of the aforementioned seven weapon barrels 11. When using such a rotating weapon barrel cluster 15, the first ammunition round or cartridge 20 only then should be fired after the rotating weapon barrel cluster 15 is rotating at the desired rated or nominal rotational speed. In other words, during such time as the weapon barrel cluster 15 of the Gatling-type gun 10 is running up to speed ammunition rounds or cartridges 20 should not be fired, that is to say, during this time the cartridges 20 should not be delivered into the Gatling-type gun or firing weapon 10. During this run-up-to-speed time of the Gatling-type gu 10 the infeed of the cartridges should be accelerated to the required firing rate or cadence of the Gatling-type gun 10, without, however, as stated, any cartridges being delivered into the Gatling-type gun FIG. 3 shows two support or carrier arms 17 and 18 secured to a socket or pedestal 16 and between which the Gatling-type gun 10 is pivotally mounted for movement about an elevation axis 42. The three ammunition containers 12, 13 and 14 are appropriately fixed to the Gatling-type gun 10 and pivot in conjunction with this Gatling-type gun 10 about the elevation axis 42.

According to the showing of FIG. 1 a transport apparatus 19 is located between the weapon barrel cluster 15 composed of the seven weapon barrels 11 and the three ammunition containers 12, 13 and 14. As best seen by referring to FIG. 2, this transport apparatus 19 serves to alternately deliver cartridges 20 from the two lateral ammunition containers 12 and 14 to the intermediate ammunition container 13. More specifically, the cartridges 20 are removed from the lateral ammunition container 14 at location 21 and from the other lateral ammunition container 12 at location 22 and are then delivered by the transport apparatus 19 at location 23 to the intermediate ammunition container 13.

FIGS. 1 and 2 reveal that this transport apparatus 19 comprises two endless transport chains or transport belts 24 and 25 or equivalent structure, and the one transport chain or transport belt 24 extends from location 21 to location 23 and the other transport chain o transport belt 25 extends from location 22 likewise to location 23. Both of these transport chains or transport belts 24 and 25 interengage with one another at location 23 such that there is alternately fed to the intermediate ammunition container 13 a respective cartridge 20 from the lateral ammunition container 12 and then from the other lateral ammunition container 14.

Within the intermediate ammunition container 13 there is located an endless storage and conveyor chain 26 which is guided over a plurality of deflection rolls 27. By means of this storage and conveyor chain 26 the cartridges 20 arrive, as generally indicated by the arrows A, from the location 23 at a transfer location 28. At this transfer location 28 the cartridges 20 are transferred from the storage and conveyor chain 26 to an infeed or conveyor chain 29 which serves to feed the cartridges 20 in a forward feed direction to the Gatling-type gun 10, as also readily seen by referring to FIG. 8. However, as will be seen from FIG. 1, the cartridges 20 are disposed within the three ammunition containers 12, 13 and 14 with their lengthwise axes oriented transverse to the lengthwise axes of the weapon barrels 11, and therefore, must be turned or twisted through 90° by the infeed chain 29. Consequently, this infeed chain 29 is appropriately constructed to be flexible, in a manner well known in this art, and thus can be turned or twisted in the required fashion. However, such turning or twisting of the infeed chain 29 has not been shown in FIG. 8 and the following figures in order to preserve clarity and simplification of the illustration. In any event, to achieve this cartridge turning result, the infeed chain 29 is guided at its lower region about a deflection roll 30 and at its upper region about a deflection roll 31 and such deflection rolls 30 and 31 are oriented at essentially right angles with respect to one another. FIG. 1 also reveals that such turning of the infeed chain 29 is accomplished within a housing or casing 32.

By means of the infeed or conveyor chain 29 not only should the cartridges 20 be delivered to the Gatling-type gun or firing weapon 10, but at the same time the empty or spent cartridge cases 33 should be transported or conveyed back from the Gatling-type gun or firing weapon 10 to the ammunition containers 12, 13 and 14. According to the showing of FIG. 10, the cartridges 20 ar delivered in the direction of the left-hand situated arrow A to the Gatling-type gun 10 at one side or run of the endless infeed or conveyor chain 29 and the empty cartridge cases 33 are withdrawn or carried away from the Gatling-type gun 10 at the other side or run of the endless infeed or conveyor chain 29 in the direction of the right-hand situated arrow A. As will be seen from FIGS. 1 and 10, a further endless storage chain 34 is located adjacent the endless infeed or conveyor chain 29. This further endless storage chain 34 is trained about five deflection rolls or wheels 35 or the like. At a transfer location 36 shown, for instance, in FIG. 1, the cartridges 20 or the empty or spent cartridge cases 33 can be transferred from the storage and conveyor chain 26 to the storage chain 34 during such time as the storage and conveyor chain 26 moves in the direction of the arrow B.

In conjunction with FIGS. 4 to 7 there will be considered in detail the construction of this transfer location 36. A gate or switch 37 is arranged at the transfer location 36. This gate 37 comprises two deflection elements 38 and 39. In the event that the gate 37 is located in the position depicted in FIG. 4, the cartridges 20 and the empty or spent cartridge cases 33 remain upon the storage and conveyor chain 26 independent of the direction of movement of the storage and conveyor chain 26. However, if the gate 37 is located in the position shown in FIG. 7, then the empty or spent cartridge cases 33 are transferred from the storage and conveyor chain 26 to the storage chain 34, which also is sometimes referred to hereinafter as a cartridge case loop. However, this is only possible when the storage and conveyor chain 26 moves in the direction of the arrow B.

Based upon the showing of FIGS. 8 to 15 there will be considered the significance of the storage chain 34.

Figure 8:
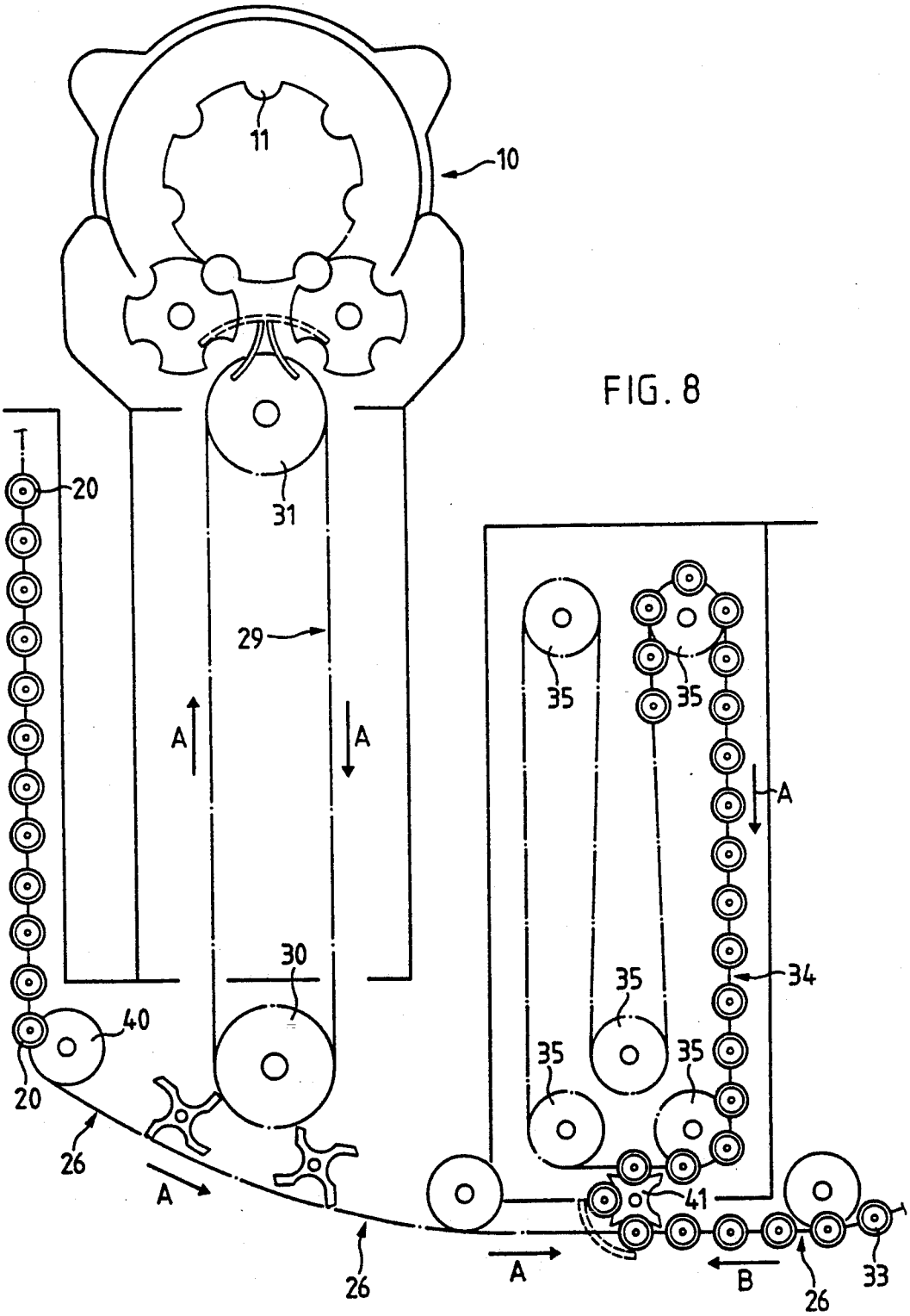
FIG. 8 depicts the cartridge infeed apparatus together with a spent cartridge case storage in a starting position for the first firing burst.
Figure 9:
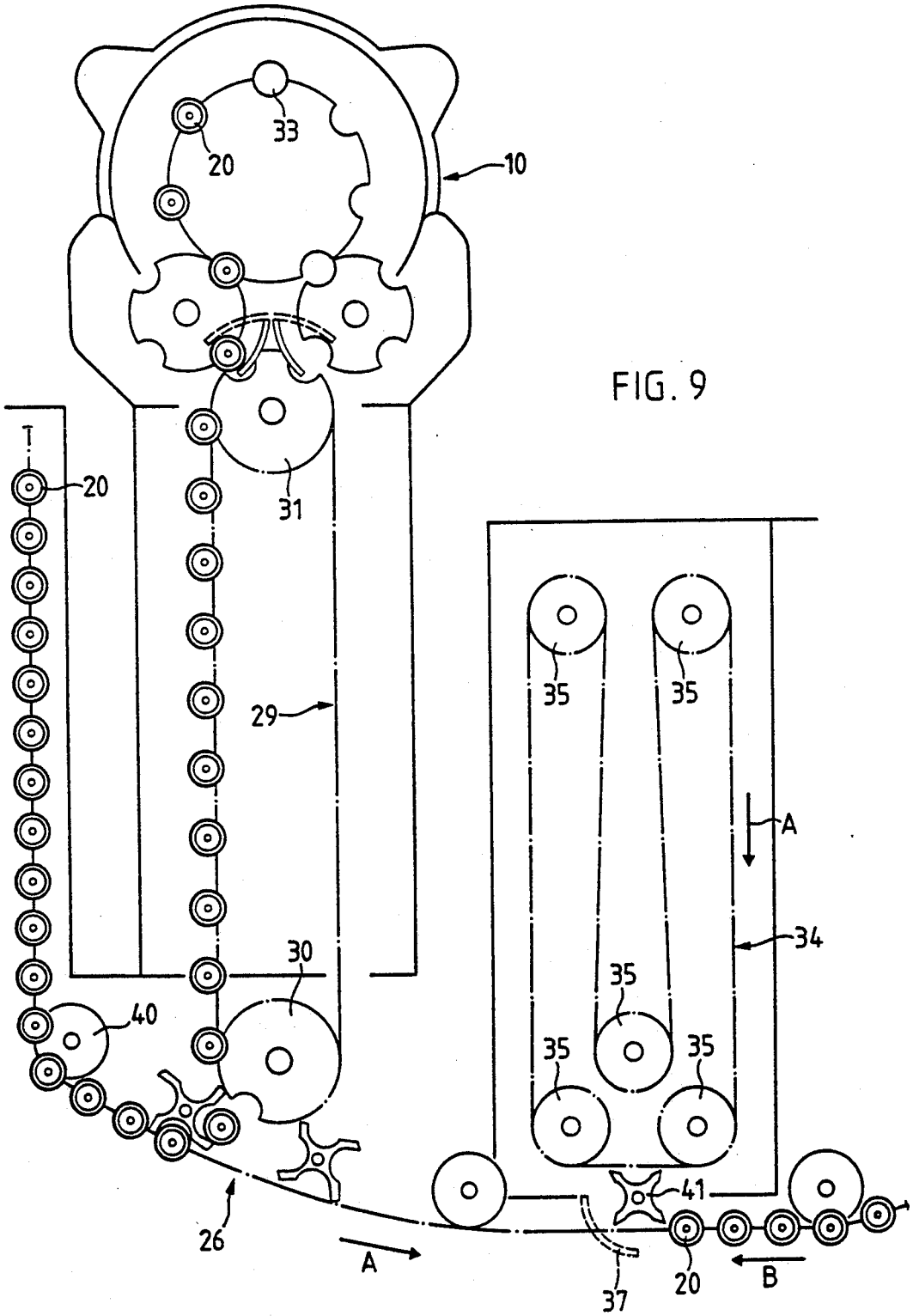
FIG. 9 depicts the cartridge infeed apparatus together with the spent cartridge case storage in a position during the firing of the first round or shot of the first firing burst.

As depicted in FIG. 8, the first cartridge or ammunition round 20, which arrives at the Gatling-type gun or firing weapon 10 upon firing thereof, is located at the region of a feeler or sensor element 40. As soon as the Gatling-type gun 10 has been switched into its mode for firing individual shots or for series firing, this first cartridge 20 is transferred from the storage and conveyor chain 26 to the infeed or conveyor chain 29 and then to the Gatling-type gun 10, as best understood by referring to FIG. 9. Until such time as this first cartridge 20 has moved through this distance, there has been completed both the run-up-to-speed of the Gatling-type gun 10 as well as the run-up-to-speed of the infeed apparatus. In other words, the storage and conveyor chain 26 and the infeed or conveyor chain 29 each move at the cadence or rate required for series firing. The cartridges 20 which were located in the storage chain 34 (FIG. 8), arrive at the storage and conveyor chain 26 (FIG. 9) during the run-up-to-speed of the Gatling-type gun 10 and the infeed apparatus. At the start of a series firing, that is to say, during firing of the first ammunition round of a first firing burst, the storage chain 34 is thus empty.

Figure 10:
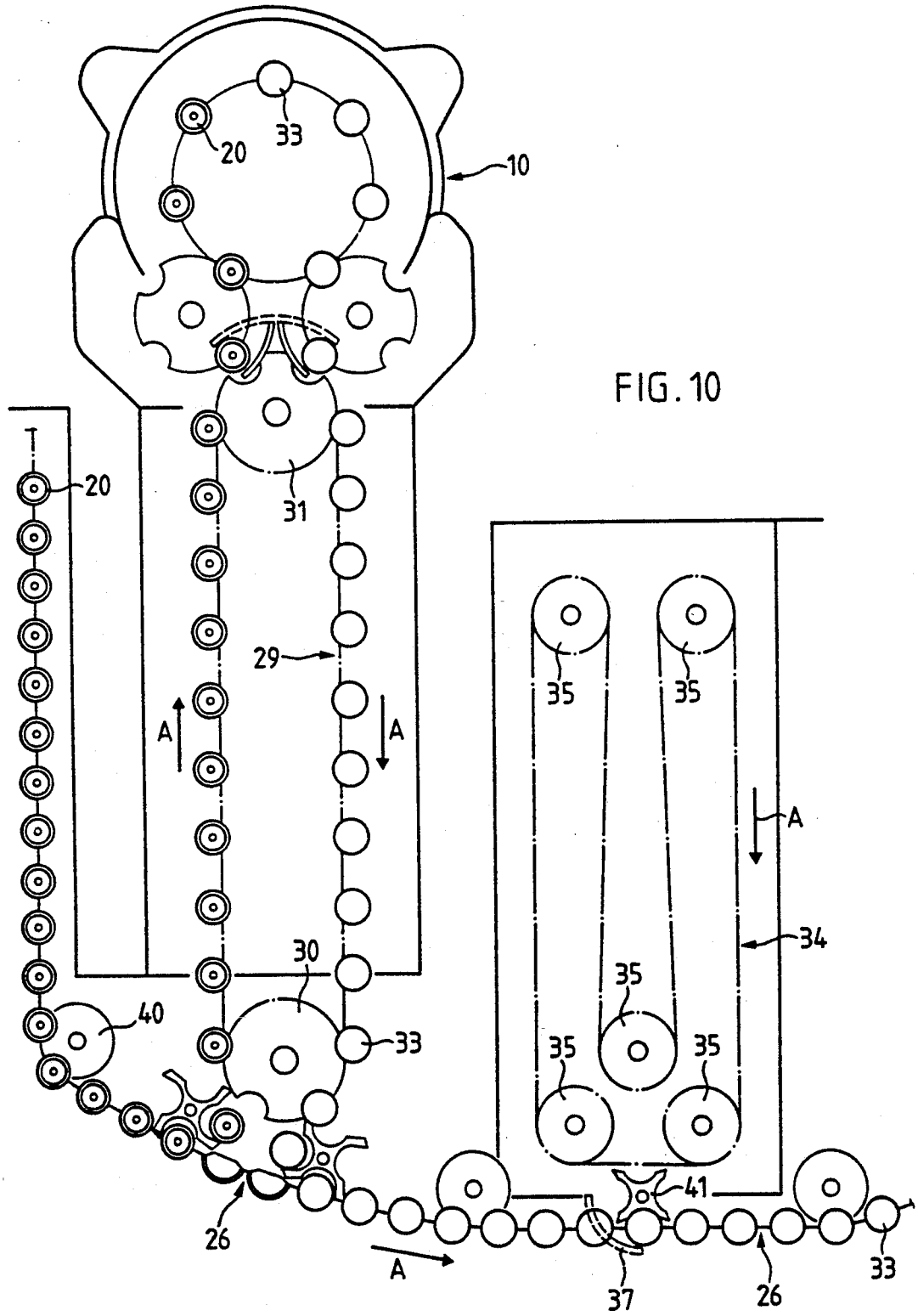
FIG. 10 depicts the cartridge infeed apparatus together with the spent cartridge case storage in a position during the firing of the last round or shot of the first firing burst.

As will be understood with reference to FIG. 10, during a series firing operation cartridges 20 are delivered by the endless infeed or conveyor chain 29, on the one hand, to the Gatling-type gun or firing weapon 10 and, on the other hand, at the same time spent or empty cartridge cases 33 are delivered to the storage and conveyor chain 26. FIG. 10 further demonstrates that during a series firing operation neither cartridges 20 nor spent cartridge cases 33 arrive at the storage chain 34. During such a series firing operation the gate 37 is located in the position depicted in FIG. 4

Figure 11:
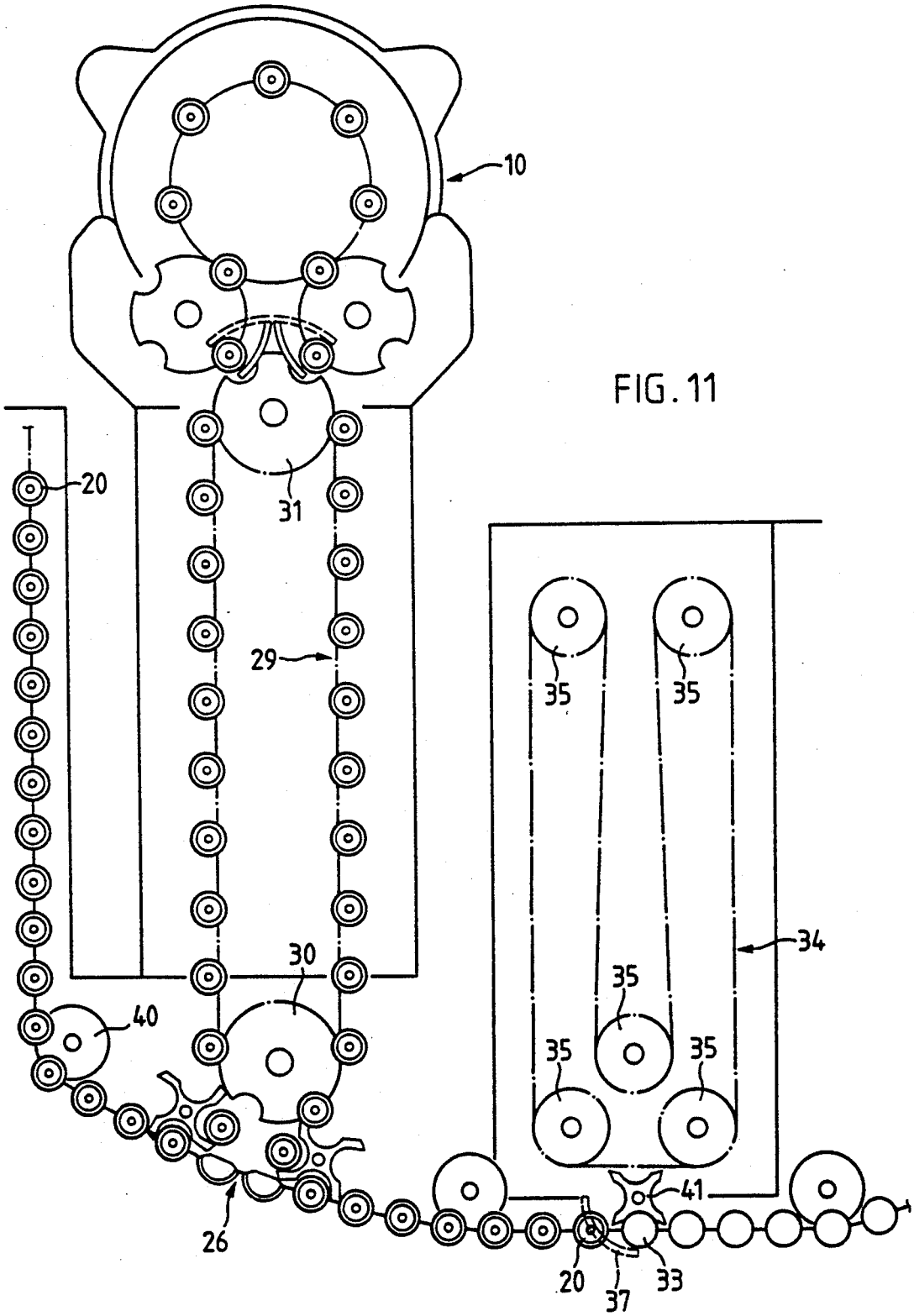
FIG. 11 depicts the cartridge infeed apparatus together with the spent cartridge case storage in a position during standstill of the firing weapon following the first firing burst.

Upon termination of a series firing operation the Gatling-type gun 10 does not immediately come to standstill, rather continues to rotate because of its considerable inertia, and thus, as depicted in FIG. 11, cartridges 20 arrive at the downwardly moving run or portion of the infeed or conveyor chain 29. As soon as the Gatling-type gun 10 has come to standstill, then, as shown in FIG. 11, the first cartridge 20 is located at the neighborhood of the gate 37, and equally, the spent or empty cartridge case 33 of the last fired ammunition round or cartridge 20 is located at the neighborhood of this gate 37.

According to the showing of FIG. 12 the cartridges 20 again must be transported back or reversed in their direction of movement. For this purpose, the storage and conveyor chain 26, the infeed or conveyor chain 29 and also the storage chain 34 move in the opposite direction, as indicated by the arrows B. At the same time there has been thrown the gate 37 into its other position. The spent cartridge cases 33 now arrive at the storage chain 34, and thus, this storage chain 34 is also conveniently referred to as a cartridge case loop. The cartridges 20 now arrive from the gate 37 at the Gatling-type gun 10 without being fired by the Gatling-type gun 10.

Figure 13:
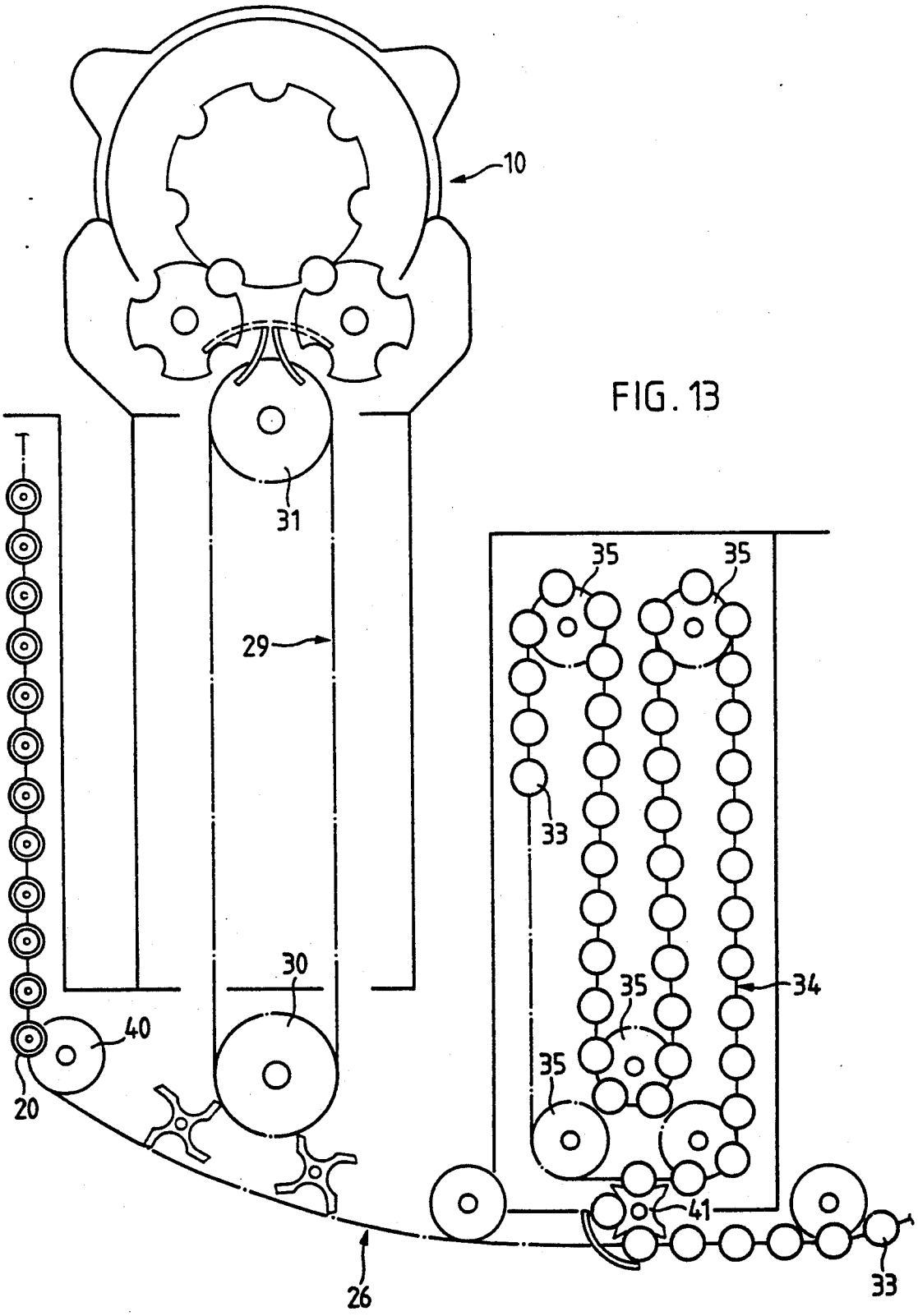
FIG. 13 depicts the cartridge infeed apparatus together with the spent cartridge case storage in a starting position for the second firing burst.

FIG. 13 depicts that the return or reverse movement is completed when the first ammunition round or cartridge 20 is again disposed at the region of the feeler or sensor element 40. During this return movement, the spent cartridge cases 33 have filled the major portion of the storage chain 34. Without the provision of this cartridge case loop 34 the described return movement would not be possible, since otherwise spent cartridge cases 33 would have had to be fed to the Gatling-type gun or firing weapon 10. Such would not be sensible, since with renewed infeed of the spent cartridge cases 33 the Gatling-type gun or firing weapon 10 would have been exposed to an additional unnecessary load and following each firing burst spent cartridge cases 33 would be located in the Gatling-type gun 10, which when undertaking a possible weapon servicing would first have to be removed, resulting in an additional expenditure in time. Through the provision of this cartridge case loop 34 there can be advantageously avoided subjecting the Gatling-type gun 10 to this additional load.

Figure 14:
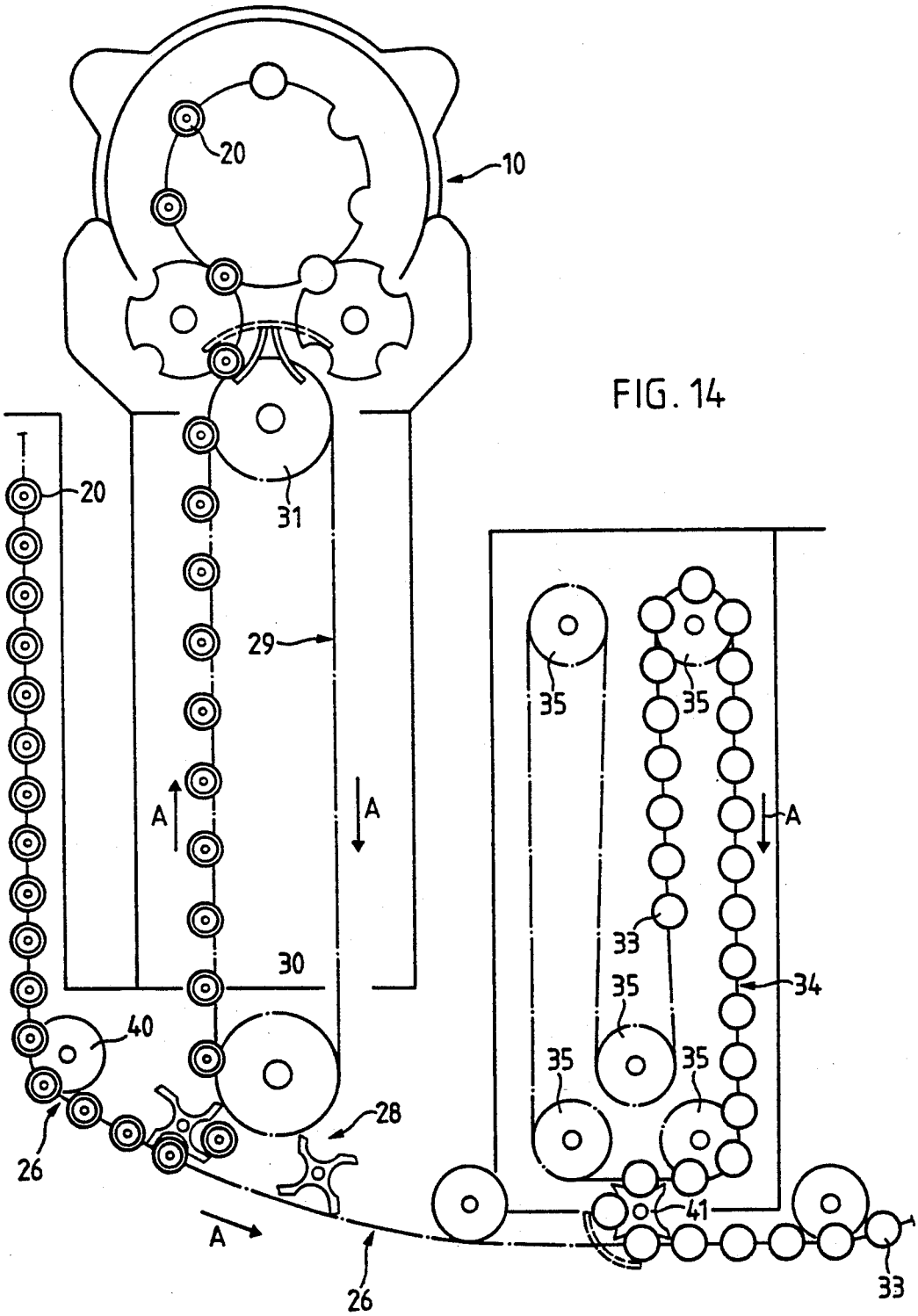
FIG. 14 depicts the cartridge infeed apparatus together with the spent cartridge case storage in a position upon firing of the first round or shot of the second firing burst.
Figure 15:
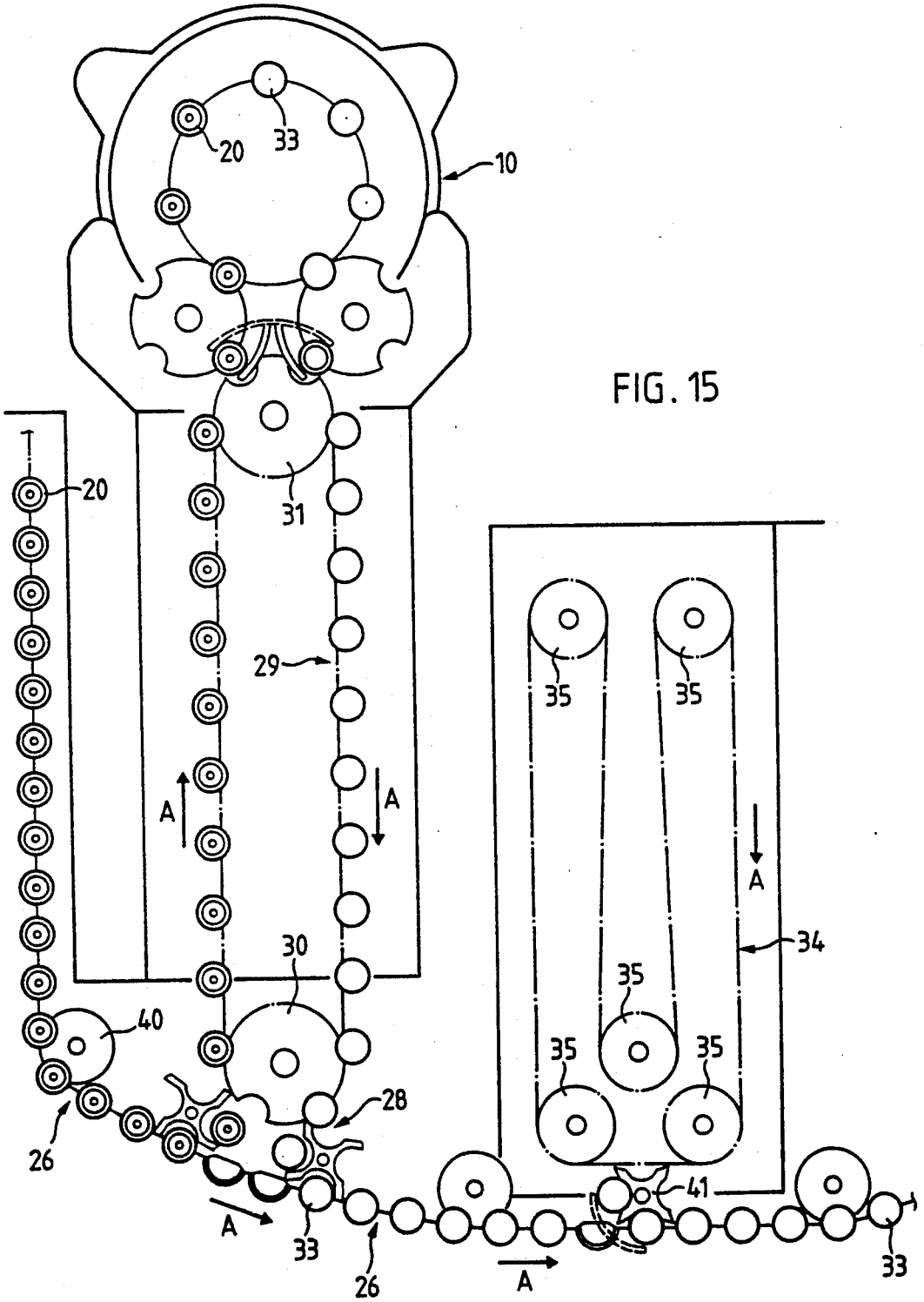
FIG. 15 depicts the cartridge infeed apparatus together with the spent cartridge case storage with the last spent cartridge case in the cartridge case storage.

As will be seen by inspecting FIG. 14, the first ammunition round or cartridge 20 of the second firing burst is first fired when the first ammunition round or cartridge 20 has moved from the feeler or sensor element 40 to the Gatling-type gun 10. During this time the storage chain or cartridge case loop 34 has again been partially emptied of spent cartridge cases 33. According to FIG. 15, the last cartridge case 33 of the first firing burst arrives from the cartridge case loop 34 directly adjacent the first cartridge case 33 of the second firing burst in the storage and conveyor chain 26 of the ammunition magazine.

FIGS. 4 to 7 show that the gate 37 is composed of a pivotable deflection element 38 and a displaceable deflection element 39. Furthermore, a conveyor star wheel or star element 41 is positioned at the transfer location 36. This conveyor star wheel or star element 41 rotates in the counterclockwise direction during such time as the cartridges 20 are infed to the Gatling-type gun 10 in the direction of the arrow A, and conversely, rotates in the clockwise direction during such time as the cartridges 20 are transported back or reversed in movement in the direction of the arrow B.

Having had the benefit of the foregoing description of the cartridge infeed apparatus, there will be now considered its mode of operation which is as follows:

Before there is fired by means of the Gatling-type gun or firing weapon 10 the first ammunition round or cartridge 20 of a firing burst, the cartridges 20 are located in the starting position depicted in FIGS. 1 and 8. As soon as there has been activated the trigger of the Gatling-type gun or firing weapon 10, the storage and conveyor chain 26 begins to move in the direction of the arrow A (FIGS. 1 and 8). At the same time the infeed or conveyor chain 29 and the storage chain 34 begin to also move in the direction of the arrow A. By virtue of this movement, on the one hand, the first cartridge 20 arrives at the Gatling-type gun 10 and, on the other hand, cartridges 20 are transported from the storage chain 34 into the storage and conveyor chain 26, as will be recognized from the showing of FIG. 9. As soon as the first cartridge 20 has arrived at the Gatling-type gun or firing weapon 10, there can be fired the first shot or ammunition round. As apparent from FIG. 10, during the first firing burst the spent or empty cartridge cases 33 are then transported by means of the infeed or conveyor chain 29 into the storage and conveyor chain 26.

Upon completion of the first firing burst, neither the Gatling-type gun 10 nor the ammunition or cartridge infeed apparatus immediately come to standstill. Therefore, as depicted in FIG. 11, a number of cartridges 20 are transported by the infeed or conveyor chain 29 to the storage and conveyor chain 26. According to the showing of FIGS. 12 and 13, after standstill of the Gatling-type gun 10 and the ammunition infeed apparatus, it is necessary to reverse the movement of the storage and conveyor chain 26, the infeed or conveyor chain 29 and the storage chain 34 in the direction of the arrows B until the first cartridge 20 is again located in its starting position at the neighborhood of the feeler element 40. During this reverse movement of the three chains 26, 29 and 34 or equivalent structure, it is necessary to prevent spent cartridge cases 33 from arriving in the Gatling-type gun 10. Therefore, at the start of the reverse movement of the three chains 26, 29 and 34 the gate 37 at the deflection location 36 must be placed in the position depicted in FIG. 7.

Figure 12:
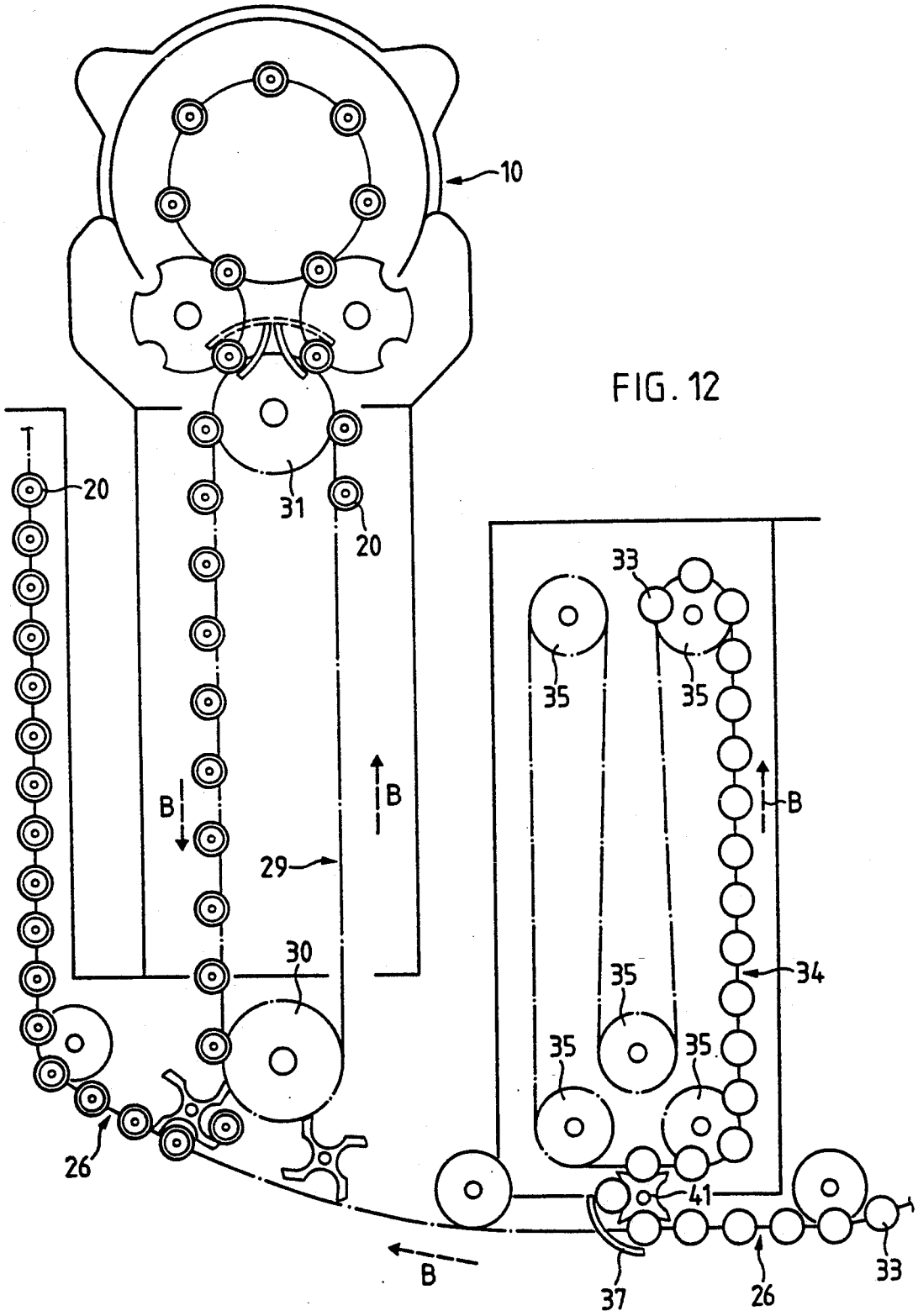
FIG. 12 depicts the cartridge infeed apparatus together with the spent cartridge case storage in a position following resetting after the first firing burst

As will be recognized from the showing of FIGS. 12 and 13, during the reverse or return movement of the three chains 26, 29 and 34, the spent or empty cartridge cases 33 are transferred into the storage chain 34. Now as soon as there should be fired a second firing burst and there has been actuated the trigger or the like of the Gatling-type gun 10, then all three chains 26, 29 and 34 again move in the direction of the arrows A. As soon as, according to the showing of FIG. 14, the first ammunition round or cartridge 20 has reached the Gatling-type gun or firing weapon 10, a portion of the spent or empty cartridge cases 33 have again been transported from the storage chain 34 onto the storage and conveyor chain 26. As will be understood from FIG. 15, as soon as during the second firing burst the first spent or empty cartridge case 33 arrives at the deflection location 36, also the last spent cartridge case 33 of the first firing burst is transported from the storage chain 34 into the storage and conveyor chain 26. As already previously mentioned, the last spent cartridge case 33 of the first firing burst arrives from the storage chain or cartridge case loop 34 directly adjacent the first cartridge case 33 of the second firing burst in the storage and conveyor chain 26 of the ammunition container 13.

While there are shown and described present preferred embodiments of the invention, it is distinctly to be understood the invention is not limited thereto, but may be otherwise variously embodied and practiced within the scope of the following claims.

What is claimed is:

1. An apparatus for the infeed of cartridges from an ammunition container to a multi-barrel gun having a rotating weapon barrel cluster, the cartridges being movable in a predetermined forward feed direction, said apparatus comprising:

the ammunition container;

a reversibly movable storage and conveyor chain arranged in the ammunition container;

a reversibly movable infeed chain for the transport of the cartridges from reversibly movable storage and conveyor chain to the gun;

a first transfer location where the cartridges from the reversibly movable storage and transport chain of the ammunition container arrive at the reversibly movable infeed chain;

a reversibly movable endless storage chain arranged in the ammunition container;

a second transfer location arranged after said first transfer location, as viewed in the predetermined cartridge forward feed direction; and a switchable gate arranged at said second transfer location, wherein during reverse movement of the reversibly movable infeed chain and the reversibly movable storage and conveyor chain, said reversibly movable endless storage chain, said second transfer location and said switchable gate enable transfer of empty cartridge cases from the reversibly movable storage and conveyor chain to the reversibly movable endless storage chain.

2. An apparatus for the infeed of cartridges to a firing weapon from an ammunition container, the cartridges being movable in a predetermined cartridge forward feed direction, said apparatus comprising:

the ammunition container;

a reversibly movable storage and conveyor chain arranged in the ammunition container;

a reversibly movable infeed chain for the transport of the cartridges from the reversibly movable storage and conveyor chain to the firing weapon;

a first transfer location where the cartridges from the reversibly movable storage and conveyor chain of the ammunition container arrive at the reversibly movable infeed chain;

a reversibly movable endless storage chain arranged in said ammunition container;

a second transfer location arranged after said first transfer location, as viewed in the predetermined cartridge forward feed direction; and switchable gate means arranged at said second transfer locating, wherein during reverse movement of the reversibly movable infeed chain and the reversibly movable storage and conveyor chain, said reversibly movable endless storage chain, said second transfer location, and said switchable gate means enable transfer of empty cartridge cases from the reversibly movable storage and conveyor chain to the reversibly movable endless storage chain.

* * * * *